US007114441B2

(12) United States Patent
Shiki

(10) Patent No.: US 7,114,441 B2
(45) Date of Patent: Oct. 3, 2006

(54) APPARATUS FOR CONTROLLING THE AMOUNT OF INK IN A PRINTING PRESS

(75) Inventor: Masaki Shiki, Fuchu (JP)

(73) Assignee: Ryobi Ltd., (JP)

( * ) Notice: Subject to any disclaimer, the term of this patent is extended or adjusted under 35 U.S.C. 154(b) by 204 days.

(21) Appl. No.: 10/884,315

(22) Filed: Jul. 2, 2004

(65) Prior Publication Data

US 2005/0005791 A1 Jan. 13, 2005

(30) Foreign Application Priority Data

Jul. 7, 2003 (JP) ..... 2003-192991

(51) Int. Cl.
*B41F 31/02* (2006.01)

(52) U.S. Cl. ..... 101/365; 101/484

(58) Field of Classification Search ..... 101/365, 101/366, 367, 483, 484
See application file for complete search history.

(56) References Cited

U.S. PATENT DOCUMENTS

| | | | | |
|---|---|---|---|---|
| 5,590,599 | A | 1/1997 | Muller et al. | |
| 6,389,968 | B1 * | 5/2002 | Sugimoto et al. | 101/365 |
| 6,412,412 | B1 * | 7/2002 | Michaud et al. | 101/365 |
| 6,453,812 | B1 * | 9/2002 | Ikeda et al. | 101/365 |
| 6,546,870 | B1 * | 4/2003 | Mayer et al. | 101/483 |
| 6,615,728 | B1 * | 9/2003 | Kurata et al. | 101/484 |
| 6,915,737 | B1 * | 7/2005 | Hirano et al. | 101/100 |
| 2002/0040649 | A1 * | 4/2002 | Michaud et al. | 101/365 |
| 2002/0124752 | A1 * | 9/2002 | Mayer et al. | 101/365 |

FOREIGN PATENT DOCUMENTS

| | | |
|---|---|---|
| DE | 0 706 885 A1 | 9/1995 |
| JP | 07-265819 | 7/1996 |

* cited by examiner

*Primary Examiner*—Ren Yan
(74) *Attorney, Agent, or Firm*—TIPS Group

(57) ABSTRACT

In an apparatus for controlling the amount of ink to be supplied to a printing plate mounted on a printing cylinder, which ink is reserved in an ink fountain and transferred by an ink transfer roller to the printing plate via plural ink rollers, where an average value of image area ratios is not less than a given value, a normal mode is selected so as to preset, prior to starting printing operation, each of the opening degrees of the plural ink fountain keys based on a main conversion curve and the number of times at which the ink transfer roller touches the ink fountain roller per a given number of rotations of the plate cylinder to a given touching frequency, and where the average value is less than the given value, a small image mode is selected so as to preset, prior to starting printing operation, each of the opening degrees of the plural ink fountain keys based on a modified conversion curve and the number of times at which the ink transfer roller touches the ink fountain roller to a touching frequency lower than the given touching frequency of the normal mode. The modified conversion curve allows the increasing rate of the opening degree of each of the plural ink fountain keys relative to the increase of the image area ratio of a corresponding zone to be higher than the increasing rate of the main conversion curve of the normal mode.

1 Claim, 8 Drawing Sheets

APPARATUS FOR CONTROLLING THE AMOUNT OF INK IN A PRINTING PRESS

CROSS REFERENCE TO RELATED APPLICATION

This application claims priority from Japanese Patent Application No. 2003-192991, which is incorporated herein by reference.

BACKGROUND OF THE INVENTION

1. Field of the Invention

The present invention relates to an improvement in an apparatus for controlling the amount of ink (hereinafter referred to an ink-amount control apparatus) in a printing press, and particularly to an ink-amount control apparatus that is capable of properly controlling the amount of ink even in a case where an image to be printed is small, an image is printed only on the part of a surface of substrate or an image to be printed lies only on the part of a printing plate.

2. Related Art

A printing press of the above type is provided with an ink unit for each plate cylinder for supplying ink to an printing plate of the plate cylinder. The ink unit supplies ink reserved in an ink fountain to the printing plate via plural ink rollers. The ink fountain is made up of an ink fountain roller and a blade. Ink flowing onto the outer circumference of the ink fountain roller via a gap between the ink fountain roller and the blade is transferred to the ink rollers located downstream to the ink fountain via an ink transfer roller. Like a pendulum, the ink transfer roller moves back and forth between the ink fountain roller and a most upstream one of the ink rollers with respect to an ink transfer direction. The number of times at which the ink transfer roller touches the ink fountain roller, per a given number of rotations of the plate cylinder remains constant throughout the printing operation, so that the more frequently the ink transfer roller touches, the larger the amount of ink is transferred to the ink roller.

The blade is made up of plural ink fountain keys aligned parallel to the axis of the ink fountain roller (a widthwise direction of a substrate fed in the printing press), with the opening degrees of the ink fountain keys being adjustable independently of each other. The larger the gap relative to the ink fountain roller or the larger the opening degree of each ink fountain key, the larger the amount of ink flowing onto the outer circumference of ink fountain roller. In recent years, an operation is made such that the image area ratio of a printing plate is calculated for each zone thereof corresponding to each ink fountain key and then the image area ratio for each zone is converted into the opening degree of each ink fountain key based on a given conversion curve, thereby presetting the thus converted opening degree of each ink fountain key prior to the printing operation. According to this presetting of the opening degree of each ink fountain key, where the image area ratio is large in a certain zone, the opening volume of a corresponding ink fountain key is increased, on the other hand, where the image area ratio is small in a certain zone, the opening degree of a corresponding ink fountain key is decreased so as to allow the decreased amount of ink flow onto the ink fountain roller for supply of a proper amount of ink. This operation may however cause a problem that the relationship between the opening volume of each ink fountain key and the amount of ink adhered to the outer circumference of the ink fountain roller is unlikely to be kept proportional after the opening degree of each ink fountain key has been decreased to a certain degree. That is, the amount of ink adhered to the ink fountain roller is not decreased corresponding to a decreased image area ratio even by setting a corresponding ink fountain key to a smaller opening degree. This results from various reasons such as leakage of ink through a gap, which may be caused in actual operation even after setting each ink fountain key at 0, or ink flow onto an adjacent portion due to the reciprocal motion of an oscillating roller in a lateral direction of the printing press, that is, a direction parallel to the axis of each roller. Thus, a larger amount of ink than an ideal amount tends to be supplied to the printing plate when the image area ratio is small.

Where an image lies only on the part of a substrate, many zones without images exist, which necessarily causes many zones with remarkably small image area ratios. This causes a problem of making it hard to perform color matching process for a print with an image printed only on the part thereof.

In light of the above problem, it is an object of the present invention to provide an ink-amount control apparatus in a printing press that is capable of providing for excellent color and detail reproduction of an image with high precision as compared with a conventional apparatus, even if the mage lies only on the part of a substrate.

SUMMARY OF THE INVENTION

According to the present invention, there is provided an apparatus for controlling the amount of ink to be supplied to a printing plate mounted on a printing cylinder, which ink is reserved in an ink fountain and transferred by an ink transfer roller to the printing plate via plural ink rollers. The ink fountain includes an ink fountain roller and a blade that is made up of plural ink fountain keys so as to define a gap between the ink fountain roller and each of the plural ink fountain keys, through which ink flows onto the ink fountain roller. The gap is opened and closed by adjusting an opening degree of each of the plural ink fountain keys. The ink transfer roller moves back and forth between the ink fountain roller and a most upstream ink roller of the plural ink rollers with respect to an ink transfer direction so as to transfer ink adhered to the ink fountain roller to the most upstream ink roller. The apparatus includes a means for controlling the opening degrees of the plural ink fountain keys independently of each other according to image area ratios of zones of the plate cylinder respectively, in which the zones are respectively defined corresponding to the plural ink fountain keys. This means calculates an average value of the image area ratios so that where the average value is not less than a given value, the means selects a normal mode so as to preset, prior to starting printing operation, each of the opening degrees of the plural ink fountain keys based on a main conversion curve and the number of times at which the ink transfer roller touches the ink fountain roller per a given number of rotations of the plate cylinder to a given touching frequency, and where the average value is less than the given value, the means selects a small image mode so as to preset, prior to starting printing operation, each of the opening degrees of the plural ink fountain keys based on a modified conversion curve and the number of times at which the ink transfer roller touches the ink fountain roller to a touching frequency lower than the given touching frequency of the normal mode, the modified conversion curve allowing the increasing rate of the opening degree of each of the plural ink fountain keys relative to the increase of the image area ratio of a corresponding zone to be higher than the increasing rate of the main conversion curve of the normal mode.

An average value of the image area ratios can be determined by, for example, summing the image area ratios of all the zones of the printing plate and dividing the summed value by the number of the ink fountain keys.

Accordingly, where an image to be printed lies only on the part of the printing plate, the small image mode is selected so that the amount of ink, which tends to be excessive in a zone with a small image area ratio, can be limited within a proper amount by decreasing the touching frequency, while securing a proper amount of ink in a zone with a large image area ratio. As a result, the color matching can be easily made in comparison with a conventional manner.

BRIEF DESCRIPTION OF THE DRAWINGS

The above, and other objects, features and advantages of the present invention will become apparent from the detailed description thereof in conjunction with the accompanying drawings wherein.

DETAILED DESCRIPTION OF THE PREFERRED EMBODIMENT

Now, the description will be made for the ink-amount control apparatus of an embodiment of the present invention with reference to the drawings attached hereto.

Figure 3:
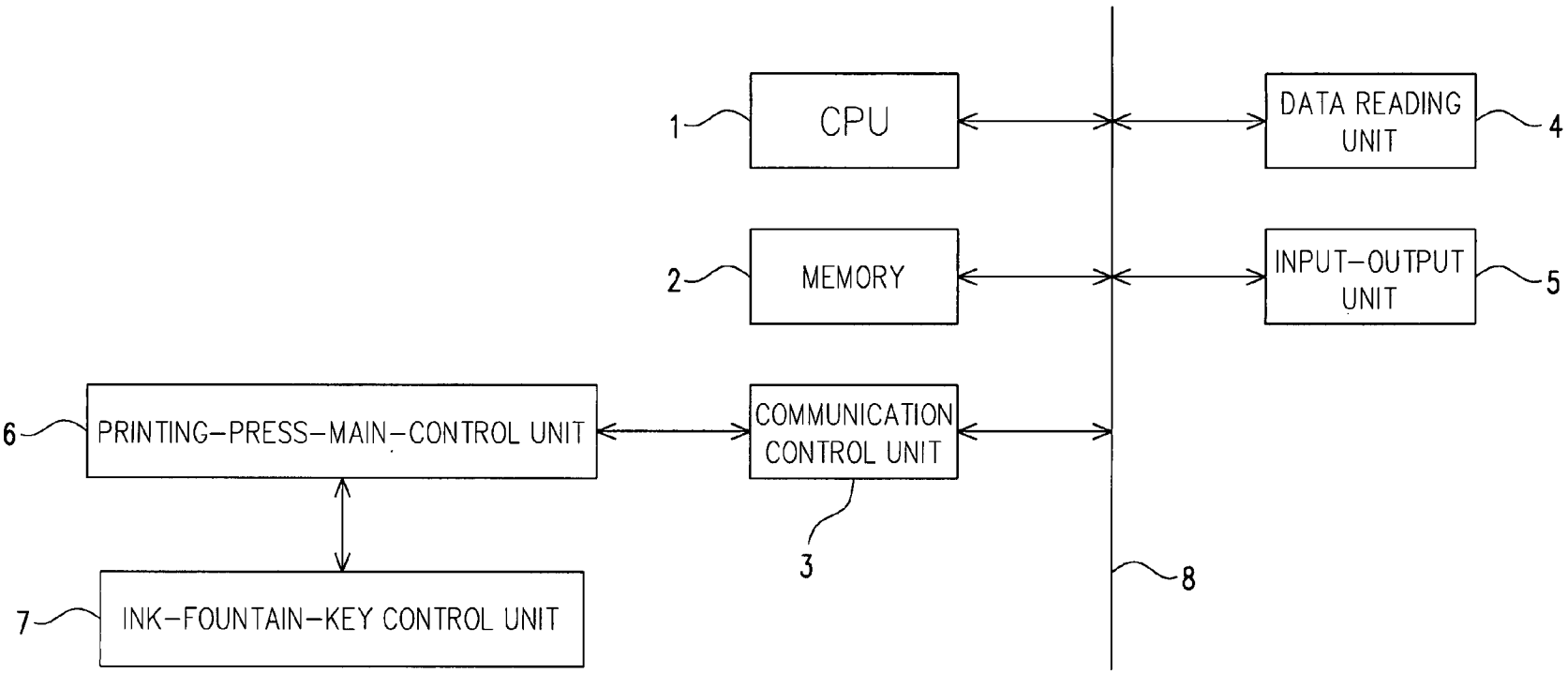
FIG. 3 is a block diagram of the ink-amount control apparatus.

FIG. 3 is a block diagram of the ink-amount control apparatus according to this embodiment. The ink-amount control apparatus includes a CPU 1, a memory 2, a communication control unit 3, a data reading unit 4, an input-output unit 5, a printing-press-main-control unit 6 and an ink-fountain-key control unit 7. The CPU 1, the memory 2, the communication control unit 3, the data reading unit 4 and the input-output unit 5 are connected to a bus line 8, while the communication control unit 3 is connected to the printing-press-main-control unit 6 with a communication cable 9, and the printing-press-main-control unit 6 is in turn connected to the ink-fountain-key control unit 7 with the communication cable 9 (cf. FIG. 1).

The CPU 1 controls each unit or device according to a program stored in the memory 2 so as to execute calculation of the opening degree of each ink fountain key. The memory 2 stores a program and various data, as well as a conversion curve for converting the image area ratio to an ink fountain key (main conversion curve, modified conversion curve). The communication control unit 3 controls communication with the printing-press-main-control unit 6. The data reading unit 4 reads out data representative of the image area ratio. The input-output unit 5 includes an input and output interface (GUI) with a keyboard, a display and the like, allowing operation by the operator based on the information on the display. The printing-press-main-control unit 6 controls the start and stop of the printing operation of the printing press, the rotations of the respective cylinders of the printing press, the rotations of the respective rollers (an ink fountain roller, an ink transfer roller, an oscillating roller, etc.) in an ink unit, as well as controlling the back-and-forth action of the ink transfer roller, that is, the number of times, at which the ink transfer roller touches the ink fountain roller (hereinafter referred to a touching frequency). The ink-fountain-key control unit 7 controls the opening and closing actions of the ink fountain keys independently of each other based on data representative of the opening degree of the corresponding ink fountain key sent from the CPU 1 via the printing-press-main-control unit 6.

Figure 1:
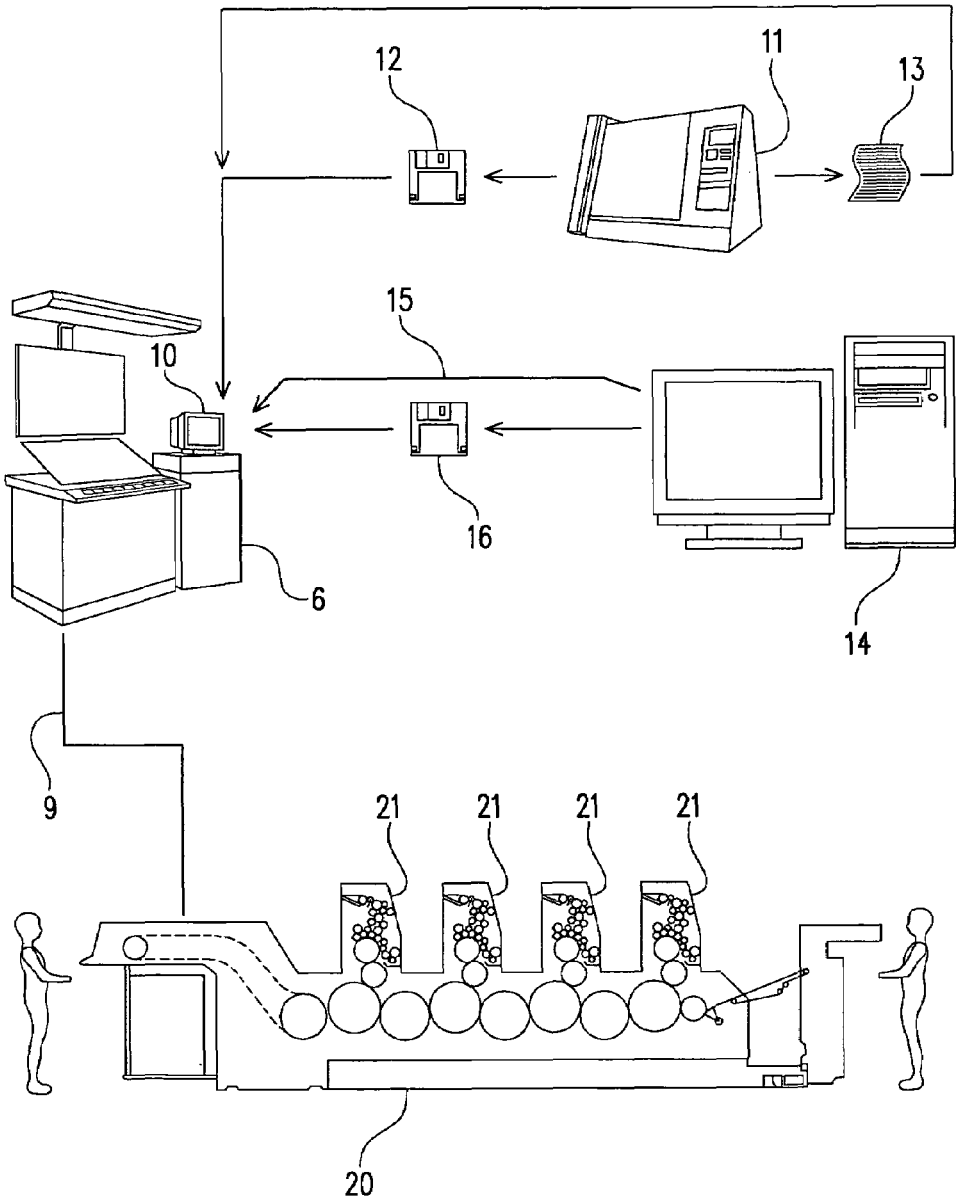
FIG. 1 illustrates the entire structure of a printing press, to which an ink-amount control apparatus according to one embodiment of the present invention has been applied.

FIG. 1 illustrates a specific structure of the printing press to which the ink-amount control apparatus of the present invention has been applied. The CPU 1, the memory 2, the communication control unit 3, the data reading unit 4 and the input-output unit 5 are all provided in a personal computer 10, into which data representative of the image area ratio (hereinafter referred simply to image area ratio data) is input by various methods. For example, the image area ratio data of a printing plate measured by an image area measuring device 11 is input into the personal computer 10 via a data media such as a flexible disk 12. Alternatively, the image area ratio data of a printing plate measured by the image area measuring device 11 is once printed out to have a printout 13 showing the data, allowing the operator to input the opening degree of each ink fountain key with a keyboard or the like of the personal computer 10 based on the information printed on the printout 13. Where the image area ratio data is calculated from digital data of a print layout before making a printing plate, the image area ratio data is calculated by another personal computer 14 and then inputted into the personal computer 10 therefrom via a network 15 or a data media such as a flexible disk 16.

The printing-press-main-control unit 6 is connected to the personal computer 10 via a communication cable (not shown) and located under the personal computer 10. This printing-press-main-control unit 6 is connected to a printing-press main body 20 via a communication cable 9. The printing-press main body 20 as illustrated in FIG. 1 is a multi-color sheet offset press with plural (a total of four) printing units 21, each printing one color on sheets. The printing units 21 are respectively provided with ink-fountain-key control units 7.

Figure 2:
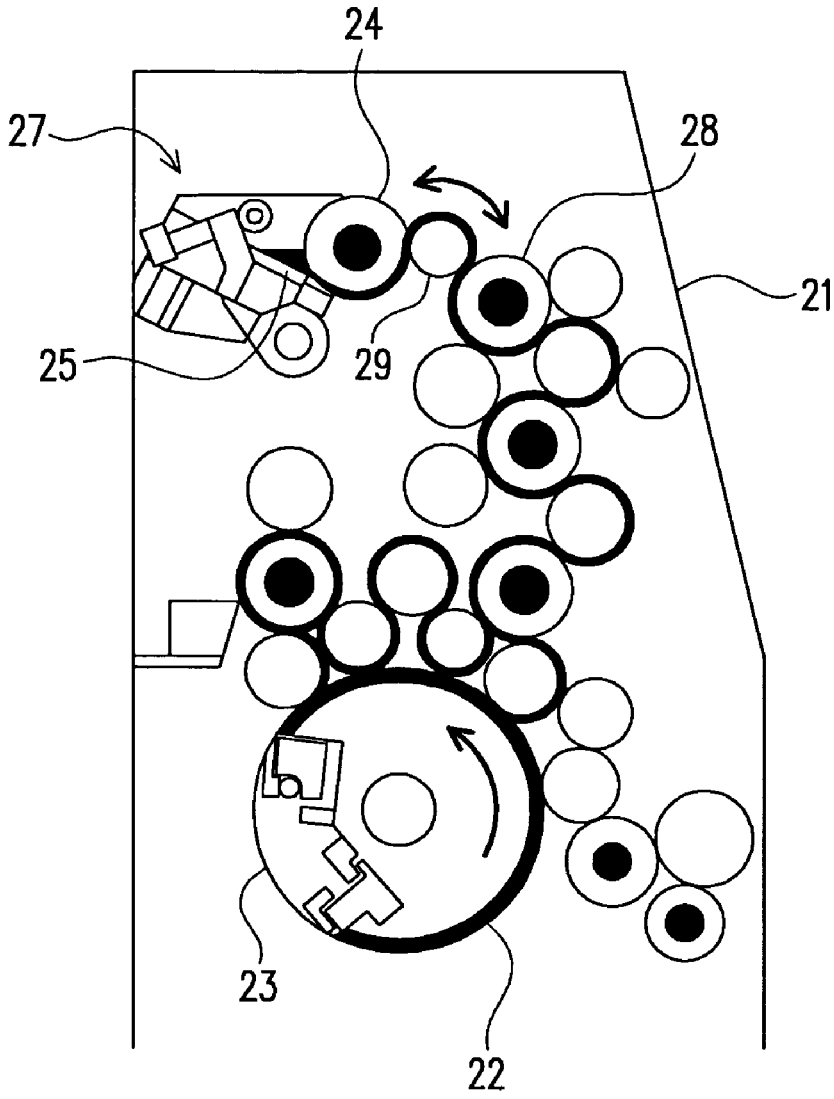
FIG. 2 is a front elevational view of an essential portion of the printing press.

A detailed structure of the printing units 21 is illustrated in FIG. 2. Each printing unit 21 includes a single plate cylinder 23 with an outer circumference on which a printing plate 22 is mounted and a single ink unit for supplying ink to the plate cylinder 23. The ink unit includes an ink fountain 27 for reserving ink, which is made up of an ink fountain roller 24 and a blade 25, plural ink rollers for supplying ink flowing from the ink fountain 27 to the plate cylinder 23, and an ink transfer roller (ductor roller) 29 that moves back and forth between the most upstream ink roller 28 and the ink fountain roller 24 while rotating around its axis, thereby transferring ink adhered to the ink fountain roller 24 to the most upstream ink roller 28. The printing-press-main-control unit 6 controls the actions of the these rollers. Accordingly, the transfer roller 29 is so controlled as to touch the ink fountain roller 24 every given number of rotations of the plate cylinder 23, in which the number of times at which the transfer roller 29 touches the ink fountain roller 24 every given number of rotations of the plate cylinder 23 is hereinafter referred to a touching frequency. In a normal mode mentioned below, the transfer roller 29 touches the ink fountain roller 24 once every two rotations of the plate cylinder 23. Some of the ink rollers are designed to function as oscillating rollers.

The blade 25 is made up of plural ink fountain keys. The corresponding ink-fountain-key control unit 7 receives data representative of the opening degrees of the respective ink fountain keys calculated by the CPU 1 via the printing-press-main-control unit 6 so as to control the opening and closing of the ink fountain keys independently of each other based on the data. The plate cylinder 23 is structured so as to mount a single printing plate 22 on its outer circumference.

Figure 4:
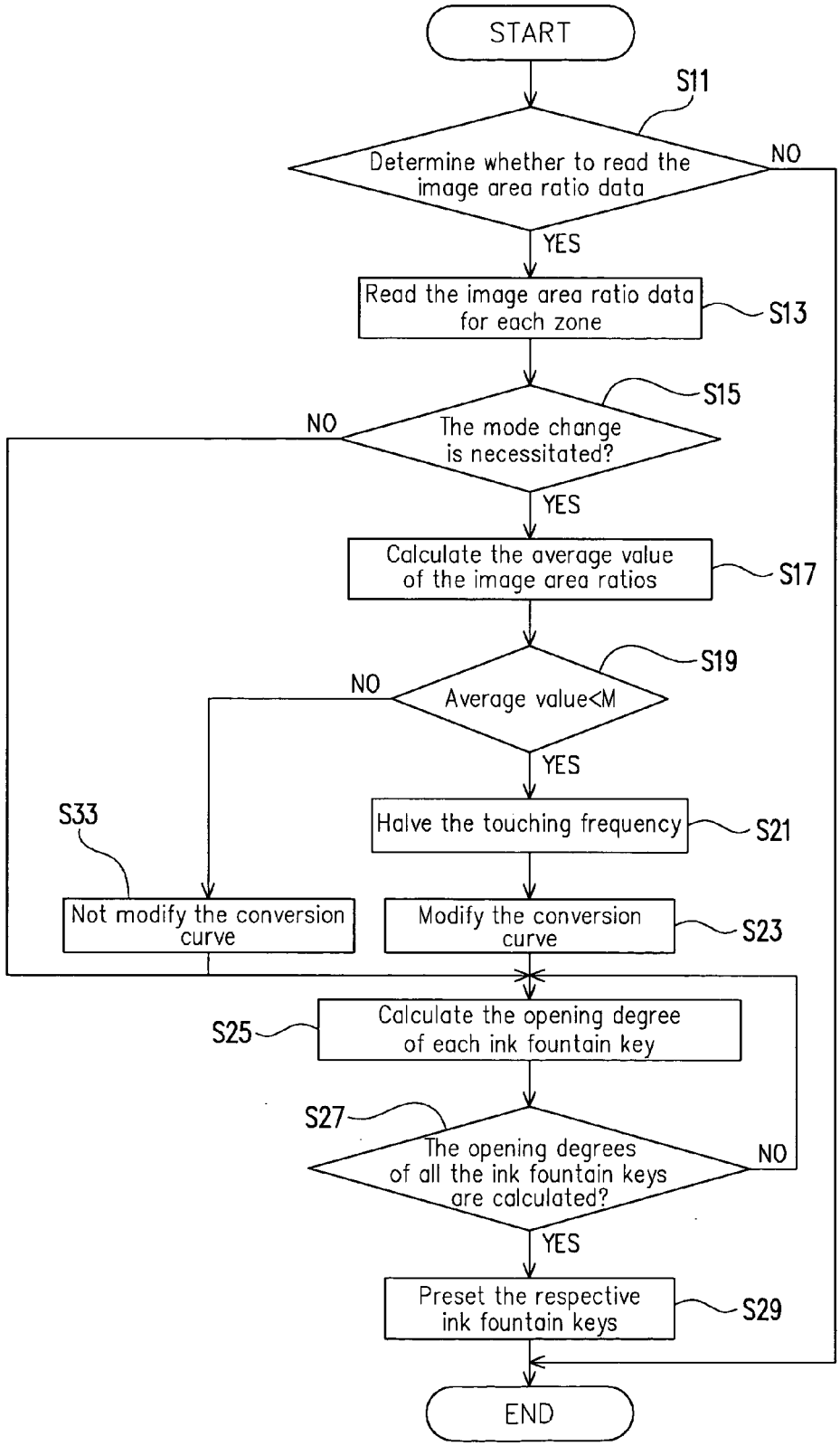
FIG. 4 is a flowchart of the ink-amount control process of the ink-amount control apparatus.

Now, the description will be made for the operational flow of the ink-amount control process with reference to the flowchart of FIG. 4.

First, the CPU 1 determines whether to read the image area ratio data based on the information inputted through the input-output unit 5 with a keyboard or the like. When it has determined to read the data, the operation proceeds from Step S11 to Step S13 to read the image area ratio data for each zone by the data reading unit 4 or the image area ratio data for each zone previously stored in a HDD or the like, which functions as the memory 2. Thus, in multi-color printing operation, the image area ratio data as read is prepared for each color. In Step S15, the necessity of the mode change is determined based on the information inputted from the input-output unit 5 so that where the mode change is necessitated, the operation proceeds to Step S17, in which the CPU 1 calculates the average value of the image area ratios of the respective zones of the printing plate. In multi-color printing operation, the average value of the image area ratios is calculated for each color. The CPU 1 then determines whether the average value exceeds a predetermined value M (Step S19). The predetermined value M is stored in the memory 2 in advance. The predetermined value M may be set to such as 10%. In multi-color printing operation, the predetermined value M may be set to a uniform value for all the colors, or may be set to be different for each color. The following description will be described with the value M being 10% in a certain printing unit.

Where the calculated average value is less than 10%, it is determined that an image to be printed lies only on the part of a printing plate or an image is printed only on the part of a substrate, thus selecting a small-image mode. That is, the operation proceeds from Step S19 to Step S21, thus decreasing the touching frequency as compared with that of the normal mode. For example, the touching frequency is halved such that the transfer roller, which touches the ink fountain roller once every two rotations of the plate cylinder in the normal mode, touches once every four rotations of the plate cylinder in the small-image mode. The operation further proceeds to Step S23, in which the CPU 1 reads from the memory 2 a modified conversion curve to be used as a conversion curve in the small-image mode.

On the other hand, in Step S19, where the calculated average value is not less than 10%, it is determined that an image to be printed does not lie only on the part of a printing plate or an image is not printed only on the part of a substrate, thus selecting the normal mode. That is, the operation proceeds from Step S19 to Step S33, in which the CPU 1 reads from the memory 2 a main conversion curve to be used in the normal mode, and then proceeds to Step 25. As mentioned above, the touching frequency in the normal mode is once every two rotations of the plate cylinder in this embodiment. Where it is determined in Step S15 that the mode change is not necessary, the operation proceeds from Step S15 to Step S25. In such a case, the touching frequency and main conversion curve of the normal mode are used.

In Step S25, the CPU 1 calculates the opening degree of each ink fountain key based on the image area ratio data in each zone with reference to the conversion curve. In this step, respectively used are the main conversion curve in the normal mode and the modified conversion curve in the small-image mode. The detailed description will be later made for the main conversion curve and the modified conversion curve. Thus, the opening degrees of all the ink fountain keys are calculated (Step S27), and data representative of the calculated opening degrees of the ink fountain keys is transmitted to the ink-fountain-key control unit 7 of each printing unit 21. The ink-fountain-key control unit 7 presets the respective ink fountain keys by opening and closing the same by the control based on the transmitted data representative of the opening degrees of these ink fountain keys (Step S29).

Now, the description will be made for an example of the ink-amount control operation respectively in the normal mode and the small-image mode.

Figure 6:
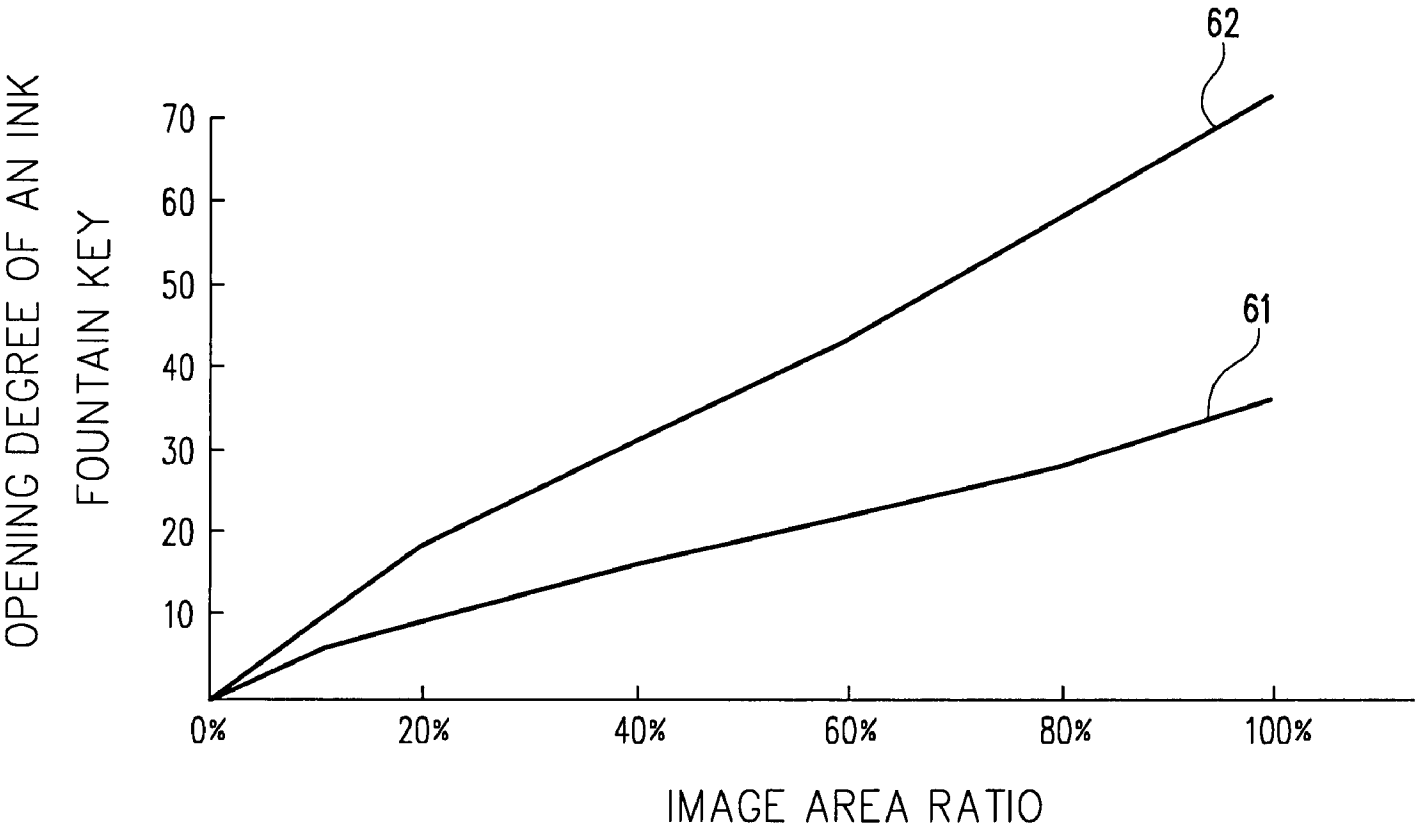
FIG. 6 is a graph illustrating the relationship between an image area ratio and the opening degree of an ink fountain key.

The ink amount control operation in the normal mode is not substantially different from a conventional operation, which involves converting the image area ratio data into the opening degrees of the ink fountain keys with reference to a generally applied, main conversion curve. A reference numeral 61 in FIG. 6 represents a main conversion curve. When the image area ratio is 0%, the opening degree of an ink fountain key is also 0. As the image area ratio is increased, the opening degree of the ink fountain key is correspondingly increased. By using this main conversion curve, the opening degree of each ink fountain key can be easily calculated from this image area ratio data.

Figure 7:
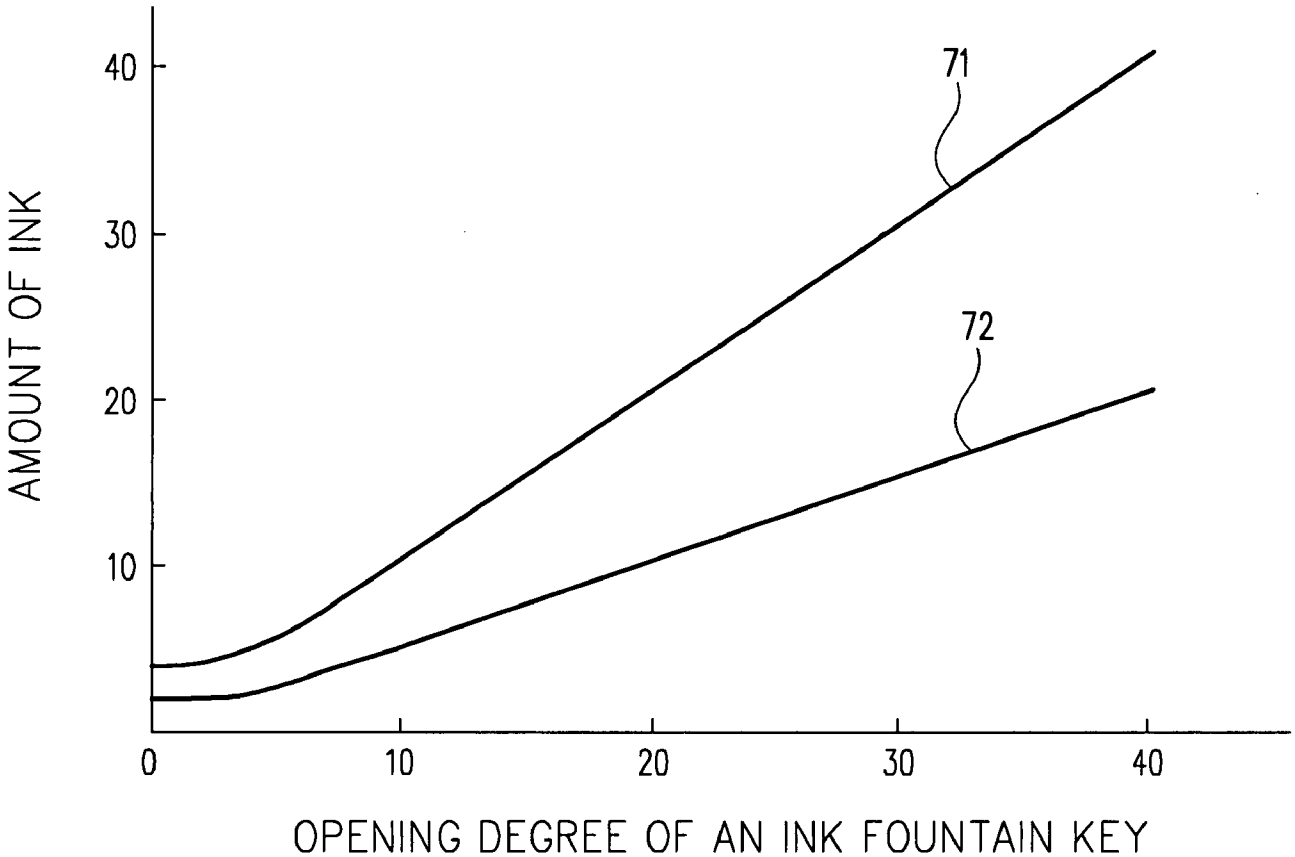
FIG. 7 is a graph illustrating the relationship between the opening degree of an ink fountain key and the amount of ink.
Figure 8:
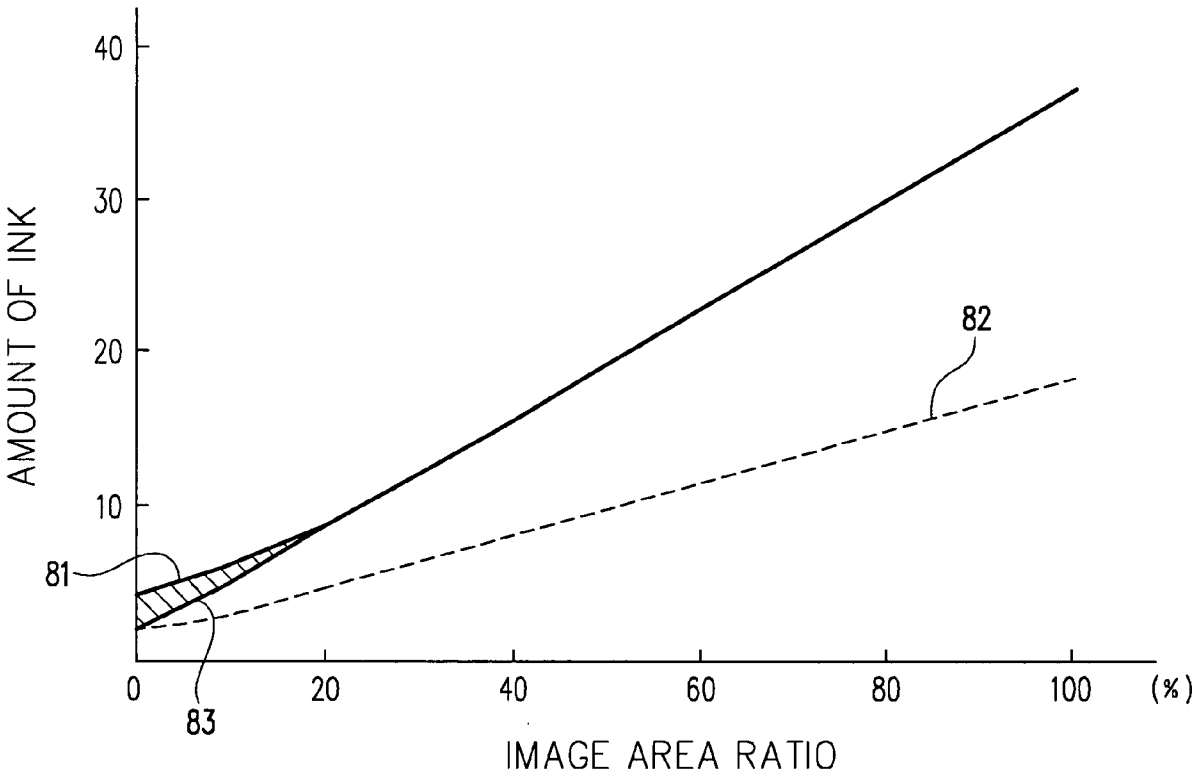
FIG. 8 is a graph illustrating the relationship between an image area ratio and the amount of ink.

FIG. 7 illustrates the relationship between the opening degree of an ink fountain key and the amount of ink adhered to the ink roller, in which a line 71 represents their relationship in the normal mode. As being apparent from the line 71, where the opening degree of the ink fountain key is excessively small, the amount of ink is not decreased correspondingly to the decrease of the opening degree of the ink fountain key. This means that even if the opening degree of the ink fountain key is set to 0, the amount of ink is not decreased to 0. Consequently, according to the relationship between the image area ratio data and the amount of ink as illustrated in FIG. 8, the amount of ink exceeds the ideal amount in a zone with an excessively small image area ratio.

Figure 5A:
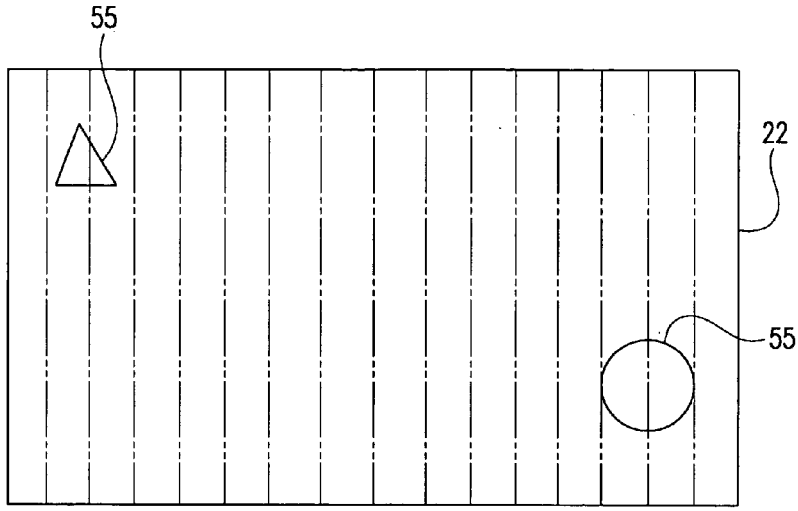
FIG. 5A illustrates an example of a printing plate.
Figure 5B:
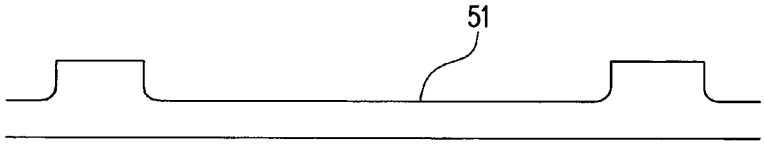
FIGS. 5B–5C each illustrate a profile of the distribution of the ink film thickness on an ink roller.

Any printing presses mostly have the above characteristic. For example, where a small image 55 lies only on the part of the printing plate 22, as illustrated in FIG. 5A, a relatively large amount of ink 50 is adhered even to a portion of the ink roller corresponding to a non-image carrying zone, as illustrated in FIG. 5B. In this case, a larger amount of ink 50 than the ideal amount is adhered even to an image carrying zone, since the image area ratio is small. Therefore, color matching is hard to be made for the printing plate 22 with such a small image area ratio. In FIG. 5A, chain double-dashed lines define zones of the printing plate 22, which respectively correspond to the ink fountain keys.

Figure 5C:
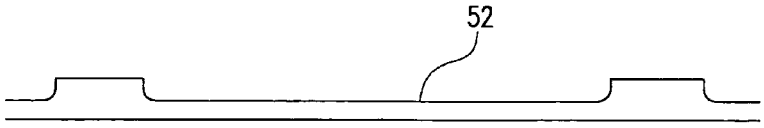

Hence, for the printing plate 22 with such a small image to be printed, the small image mode is selected. That is, an averaged value of the image area ratios of the respective zones is calculated, so that where the averaged value is less than a given value, it is determined that an image lies only on the part of the printing plate 22, thus selecting the small image mode. In the small image mode, the touching frequency is set to such as a half (½) of that in the normal mode. With the halved touching frequency, the amount of ink transferred from the ink fountain roller 24 to the most upstream ink roller 28 is reduced to the half. Therefore, the amount of ink relative to the opening degree of the ink fountain key remains constant, that is maintained at ½ of that in the normal mode. A line 72 in FIG. 7 represents the relationship between the opening degree of the ink fountain key and the amount of ink in the small image mode. Given that the main conversion curve is employed as a conversion curve without modification thereto, the amount of ink is decreased to a half in a region with a large image area ratio, while it comes close to the ideal value in a region with a small image area ratio, as represented by a dotted line 82 in FIG. 8. Consequently, as illustrated in FIG. 5C, ink 52 is decreased to the half in comparison with the case of FIG. 5B. Supplied ink is uniformly decreased to the half across the entire zones of the printing plate regardless of the presence or absence of an image. This means that although a half amount of ink is preferable in a region carrying no image, there might be a case where such amount of ink is not enough, depending on the size of an image. Therefore, the main conversion curve is replaced with the modified conversion curve for use in the small image mode.

Figure 5D:
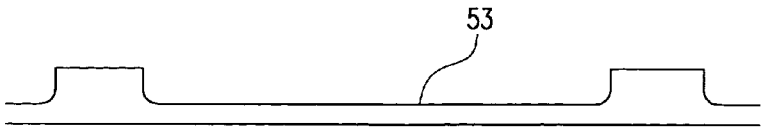

A line 62 in FIG. 6 represents the modified conversion curve, in which the increasing rate of the opening degree of the ink fountain key relative to the increase of the image area ratio is about twice as much as the increasing rate in the main conversion curve. Thus, in the small image mode, the decreased touching frequency is employed while employing the modified conversion curve with the increasing rate of the opening degree of the ink fountain key relative to the increase of the image area ratio being higher than that of the normal mode, so that the amount of ink is brought close to a substantially ideal value even in a region with a large image area ratio, as well as in a region with a small image area ratio. A line 83 in FIG. 8 represents the relationship between the image area ratio and the amount of ink in the small image mode, in which a portion defined by the line 81 and the line 83 (a hatched portion) indicates that the amount of ink has been modified as a result of the operation in the small image mode. Consequently, as illustrated in FIG. 5D, ink 53 adhered to the ink roller is decreased on its portion corresponding to a non-image carrying zone, while being more decreased even on a portion corresponding to an image carrying zone as compared with the case of FIG. 5B and hence brought close to an ideal value. Therefore, the color matching is relatively easily performed by selecting this small image mode. Another advantage is that whether or not an image lies only on the part of the printing plate can be easily determined since such determination is made by using the average value of the image area ratios of the respective zones in each color.

The halved touching frequency in the small image mode than the touching frequency of the normal mode is not essential in the present invention. This touching frequency may be decreased to one third (⅓) or any other value. Accordingly, the modified conversion curve is properly changed.

Thus, where an image to be printed lies only on the part of the printing plate, the small image mode is selected so that the amount of ink, which tends to be excessive in a zone with a small image area ratio, can be limited within a proper amount by decreasing the touching frequency, while securing a proper amount of ink in a zone with a large image area ratio. As a result, the color matching can be easily made in comparison with a conventional manner.

This specification is by no means intended to restrict the present invention to the preferred embodiments set forth therein. Various modifications to the apparatus for controlling the amount of ink in a printing press, as described herein, may be made by those skilled in the art without departing from the spirit and scope of the present invention as defined in the appended claims.

What is claimed is:

1. An apparatus for controlling the amount of ink to be supplied to a printing plate mounted on a printing cylinder, which ink is reserved in an ink fountain and transferred by an ink transfer roller to said printing plate via plural ink rollers, wherein:

said ink fountain includes an ink fountain roller and a blade, said blade made up of plural ink fountain keys so as to define a gap between said ink fountain roller and each of said plural ink fountain keys, through which ink flows onto said ink fountain roller, said gap being opened and closed by adjusting an opening degree of each of said plural ink fountain keys;

said ink transfer roller moves back and forth between said ink fountain roller and a most upstream ink roller of said plural ink rollers with respect to an ink transfer direction so as to transfer ink adhered to said ink fountain roller to said most upstream ink roller;

said apparatus comprises a means for controlling the opening degrees of said plural ink fountain keys independently of each other according to image area ratios of zones of said plate cylinder, said zones respectively defined corresponding to said plural ink fountain keys, wherein said means calculates an average value of said image area ratios so that where said average value is not less than a given value, said means selects a normal mode so as to preset, prior to starting printing operation, each of the opening degrees of the plural ink fountain keys based on a main conversion curve and the number of times at which said ink transfer roller touches said ink fountain roller per a given number of rotations of said plate cylinder to a given touching frequency, and where said average value is less than said given value, said means selects a small image mode so as to preset, prior to starting printing operation, each of the opening degrees of the plural ink fountain keys based on a modified conversion curve and the number of times at which said ink transfer roller touches said ink fountain roller to a touching frequency lower than said given touching frequency of said normal mode, said modified conversion curve allowing the increasing rate of the opening degree of each of said plural ink fountain keys relative to the increase of the image area ratio of a corresponding zone to be higher than the increasing rate of the main conversion curve of the normal mode.

* * * * *